US006217073B1

(12) United States Patent
Hoffman

(10) Patent No.: US 6,217,073 B1
(45) Date of Patent: Apr. 17, 2001

(54) COLLAPSIBLE SNOW POLE

(76) Inventor: Paul Hoffman, 1234 Roanoke Rd, San Marino, CA (US) 91108

( * ) Notice: Subject to any disclaimer, the term of this patent is extended or adjusted under 35 U.S.C. 154(b) by 0 days.

(21) Appl. No.: 09/153,944

(22) Filed: Sep. 16, 1998

(51) Int. Cl.[7] ..... A63C 11/22

(52) U.S. Cl. ..... 280/823; 280/824; 135/66; 135/70

(58) Field of Search ..... 280/823, 824, 280/819, 812, 816; 135/66, 70

(56) References Cited

U.S. PATENT DOCUMENTS

| | | | | |
|---|---|---|---|---|
| D. 349,144 | * | 7/1994 | Greene | D21/229 |
| 1,621,255 | * | 3/1927 | Hunter | 135/70 |
| 2,289,818 | | 7/1942 | Winner et al. | 280/11.37 |
| 2,490,183 | * | 12/1949 | Wheeler | 280/11.37 |
| 2,705,015 | | 3/1955 | Langlais | 135/45 |
| 2,757,011 | * | 7/1956 | Dormoy | 280/819 |
| 2,818,290 | | 12/1957 | Harocopo | 287/58 |
| 3,378,272 | | 4/1968 | Lewis | 280/11.37 |
| 3,635,233 | | 1/1972 | Robertson | 135/47.5 |
| 3,722,903 | | 3/1973 | Jones | 280/11.37 |
| 3,730,544 | | 5/1973 | Hyman | 280/11.37 |
| 3,738,674 | * | 6/1973 | Pauls | 280/816 |
| 3,797,845 | | 3/1974 | Kepka et al. | 280/11.37 |
| 3,868,122 | * | 2/1975 | Negi | 280/816 |
| 3,885,805 | * | 5/1975 | Solymosi | 280/606 |
| 3,948,535 | * | 4/1976 | Negi | 280/816 |
| 4,114,911 | | 9/1978 | Laird et al. | 280/11.37 |
| 4,130,294 | | 12/1978 | Walker | 280/11.37 |
| 4,288,102 | * | 9/1981 | Ramer | 280/823 |
| 4,332,399 | | 6/1982 | Kepple | 280/819 |
| 4,363,495 | * | 12/1982 | Henson | 280/14.2 |
| 4,424,987 | | 1/1984 | Ryder | 280/823 |
| 4,593,933 | * | 6/1986 | Nunno | 280/812 |
| 4,596,405 | | 6/1986 | Jones | 280/823 |
| 4,759,570 | * | 7/1988 | Dandy, III | 280/812 |
| 4,793,627 | * | 12/1988 | Monreal | 280/606 |
| 4,921,274 | * | 5/1990 | Holman | 280/812 |
| 4,953,892 | * | 9/1990 | Adkins | 280/814 |
| 5,110,154 | * | 5/1992 | Street | 280/822 |
| 5,139,283 | | 8/1992 | Dow et al. | 280/819 |
| 5,451,078 | * | 9/1995 | Ohata | 280/810 |
| 5,941,435 | * | 8/1999 | Munro, III | 224/267 |

* cited by examiner

*Primary Examiner*—Brian L. Johnson
*Assistant Examiner*—Bridget Avery
(74) *Attorney, Agent, or Firm*—Christie, Parker & Hale, LLP

(57) ABSTRACT

An extendable and retractable snow pole which is particularly useful by snowboarders. In the retracted position the pole is adapted to be mounted on the snowboard between the front and rear bindings. In the extended position the pole is adapted to be gripped by the snowboarder at one end and utilizes a basket affixed to the opposite end of the pole to push the user along the surface of the snow or ice enabling him to more easily traverse a flat area or to aid him in getting upright after a fall. The length of the snow pole is adjustable to a plurality of positions. The grip end of the pole is pivotally mounted and the plate or basket end can be rotated upwardly such that a portion of the basket overlaps the rear leg or knee of the user to support the rear end of the snowboard when the user is seated on a chairlift. Detent mechanisms provide easy access for extending and retracting the pole. A second detent mechanism enables a pivotable and removable connection of the grip end of the pole from the snowboard. A clip secures the front end of the pole to the board when it is stored in the retracted position.

8 Claims, 7 Drawing Sheets

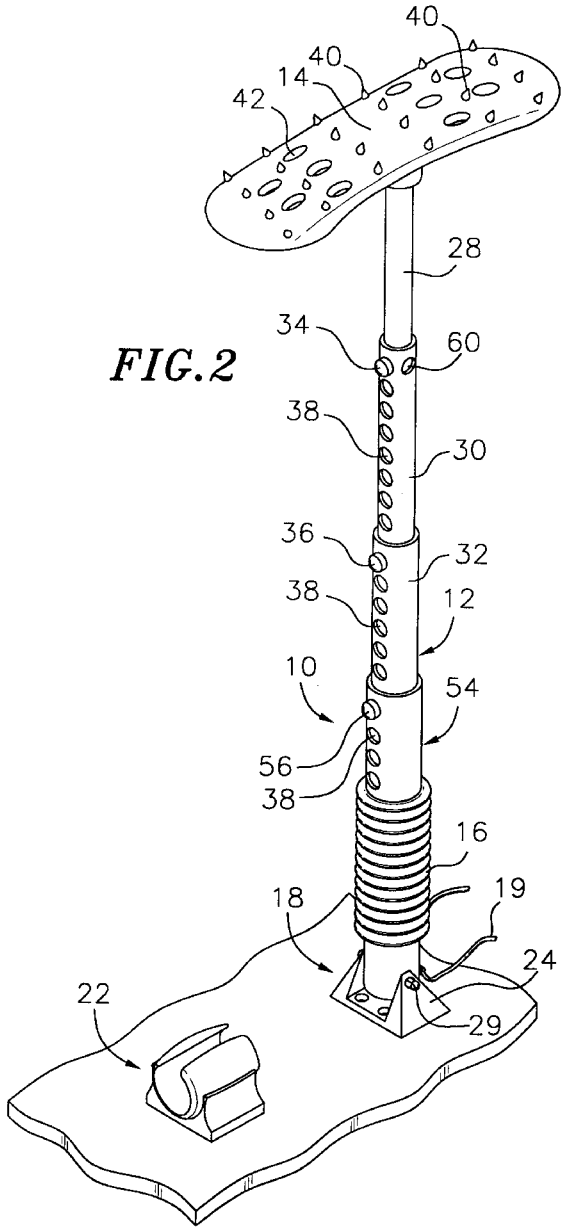
FIG.2
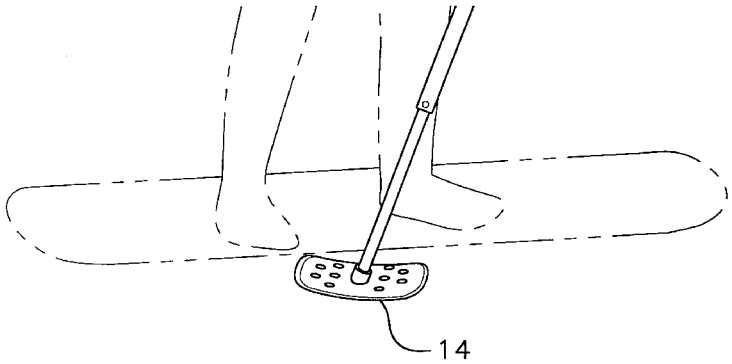

COLLAPSIBLE SNOW POLE

BACKGROUND OF THE INVENTION

1. Field of the Invention

This invention relates to snow poles and in particular to a single pole suitable for use by snowboarders.

2. Summary of the Prior Art

A significant number of collapsible and adjustable ski poles are found in the prior art. In U.S. Pat. No. 2,289,818 an adjustable ski pole is disclosed in which the sections telescope within one another. The '818 patent also discloses the concept of a detent mechanism for locking the sections of the ski pole in position. Other adjustable ski poles which are extendable and retractable are disclosed in U.S. Pat. No. 4,596,405, U.S. Pat. No. 4,424,987 and U.S. Pat. No. 4,114,911. The '911 patent discloses a ski pole with a telescoping construction wherein the ski pole when retracted is collapsed to half of its length and the handle portion of the ski pole comprises a mechanism that can be opened and spread apart to provide a seat for the skier without having to take off his skis. In U.S. Pat. No. 3,722,903 an adjustable ski pole with a split retainer ring is disclosed. The overall length of the pole is adjusted to the skier's height. The pole has upper and lower sections which are telescopically joined and equipped with a manually controllable coupling means. The coupling means embodies an outer sleeve having an internal stop shoulder at its lower end and wholly encompassing a longitudinally split inner expansible and contractible sleeve.

The ski poles which are disclosed in the prior art are normally used in pairs and are particularly suited for use by Alpine and cross-country skiers who utilize a pair of skis, one on each foot. Recently, snowboards have enjoyed increasing popularity and ski slopes are populated now with almost as many snowboarders as they are with conventional Alpine skiers.

A snowboard is a single board with a pair of bindings located on the board at spaced-apart positions. Typically, a binding for either the left foot or the right foot is located toward the front end of the snowboard and a binding for either the right foot or left foot is located toward the rear of the snowboard. The foot configuration is dependent on the snowboarder's stance preference. A spacing of 10 to 16 inches is usually found between the bindings.

A downhill run on a snowboard resembles the ride and action of a surf board on water. A snowboarder normally does not utilize any ski poles and relies for maneuvering on the ability to shift his weight from side to side and backwards and forwards to control his speed and direction of travel. At the end of a run the snowboarder typically disengages his back or rear foot from the rear binding and advances to a chairlift or other destination by sliding the board forward with his front foot and walking or pushing with his back foot. Also, on certain occasions during his normal runs or after disembarking from a chairlift, a snowboarder will encounter a terrain that does not have enough inclination to allow the force of gravity to pull the snowboarder along and has to be traversed by pushing with his back foot. In such situations, it is desirable that the snowboarder have a pole which would allow him to push himself along the flat surface rather than having to disengage the back binding or even both bindings, and endure a walk or push/slide along the flat area until the next slope is encountered. This will also alleviate the need to unbuckle and re-buckle the binding or bindings once again before and after traversing the flat area.

SUMMARY OF THE INVENTION

The present invention provides a pole for use in traversing snow surfaces. The pole comprises a manually extendable and retractable shaft. A plate or basket of a predetermined configuration is mounted at one end of the shaft and a releasable attachment mechanism is transversely mounted at the "grip" end of the shaft opposite the plate or basket. The releasable attachment is used to secure said end of the ski pole to the snowboard.

In another aspect, the invention provides a snowboard and pole combination which comprises an elongated snowboard having a pair of spaced-apart bindings located along the longitudinal axis of the snowboard. The bindings are disposed at an angle across the board. A manually extendable and retractable pole is mounted on the snowboard and is secured to the snowboard between the bindings. A plate or basket of a predetermined configuration is transversely attached at one end of the pole and a detent mechanism is located at the opposite or "grip end" of the pole. A bracket is mounted on the snowboard adjacent the rear binding to receive the grip end of the ski pole and pins of a detent mechanism. A clip is mounted on the board adjacent the front binding to receive the shaft of the pole and secure-the plate or basket end of the pole to the board. When the pole is removed from the board and extended to its elongated and locked state, the pole can be used as a pole to enable the user to traverse a level area or to aid the snowboarder in getting upright after a fall, especially in deep snow or in a "tree well."

The snow pole of the present invention is easily attached and detached from the snowboard. A detent mechanism at the grip end engages a bracket on the snowboard. A flexible clip at the opposite end grasps the shaft of the snow pole when the pole is in its retracted position. When in use, the snowboarder reaches down and releases the detent mechanism at the grip end and pulls the shaft from the flexible clip. Then, utilizing detent mechanisms along the shaft of the pole, the telescoped tubes of the pole are extended to the desired length and locked into position by one or more detent mechanisms. The snowboarder then places the basket end of the pole against the snow surface and pushes himself along the surface of the snow.

The pole has an additional and separate use. It is used to support the rear end of the board when the snowboarder is riding a chairlift. In the chairlift line, prior to boarding the chairlift, the snowboarder releases the rear binding to free the rear foot, enabling the snowboarder to push him/herself onto the chairlift. Consequently, the rear end of the snowboard will dangle or hang down during the duration of the chairlift ride. This additional use as a snowboard support while riding the chairlift is accomplished by releasing the plate or basket end of the pole from the clip and raising the basket upwardly, while at the same time, manually adjusting the detent mechanisms on the pole shaft, until it reaches the approximate height of the snowboarder's knee. The pole is detached only at the plate or basket end, and the grip end of the pole remains attached to the board via the rear mounting/hinge bracket. The basket is then placed on the top of the snowboarder's knee thereby supporting the rear end of the snowboard and maintaining the board in a near horizontal position. This significantly removes and releases the weight and the twist on the snowboarder's front ankle and foot that is attached to the snowboard during the chairlift ride, and likewise, eliminates the tension and strain on the ankle typically caused by the weight of the board normally hanging down freely.

BRIEF DESCRIPTION OF THE DRAWINGS

The invention is illustrated in the accompanying drawings in which:

FIG. 2 is a perspective view of the pole in the extended position shown in position adjacent to, but removed from the flexible clip.

DETAILED DESCRIPTION OF THE INVENTION

Figure 1:
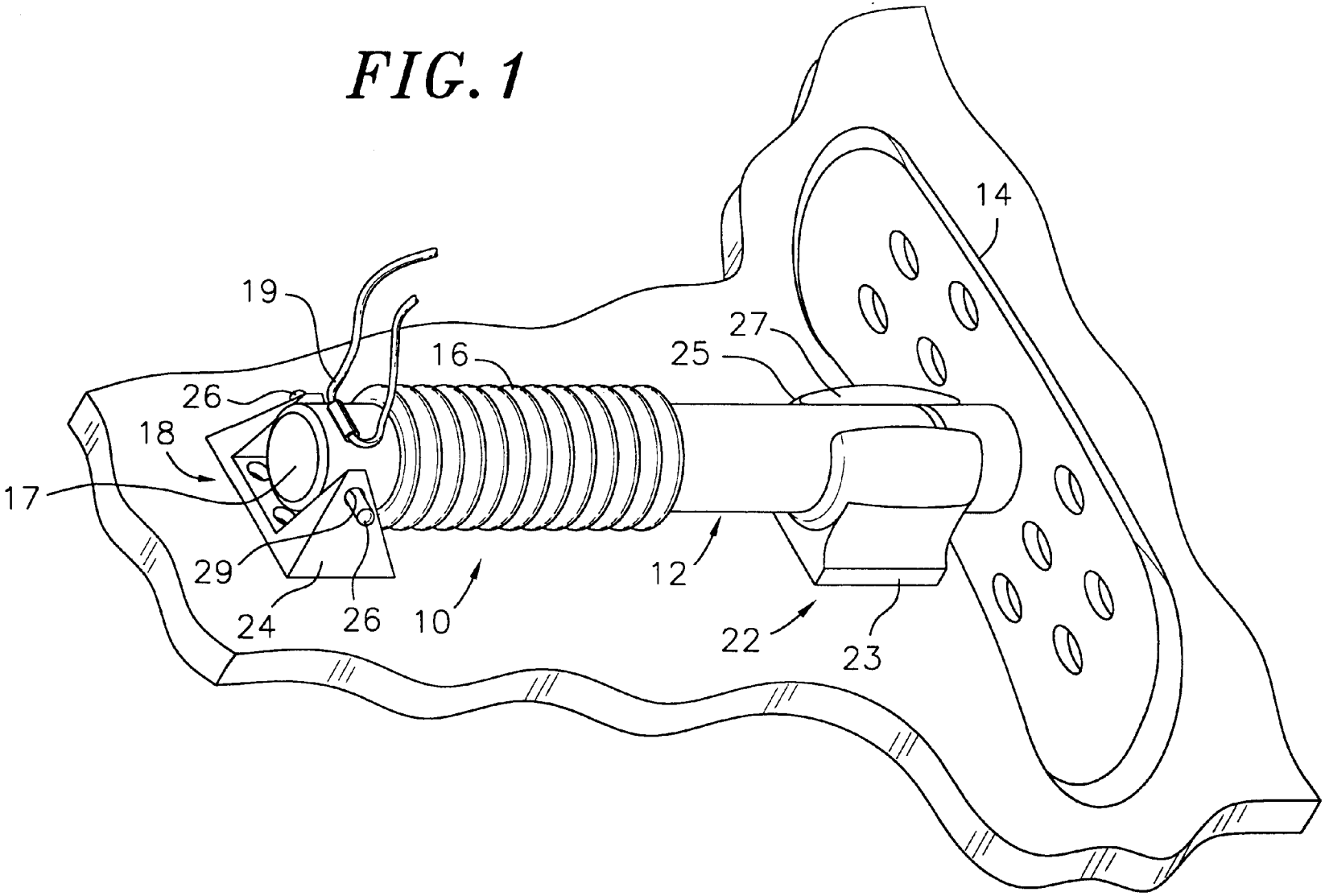
FIG. 1 is a perspective view of the pole according to the present invention mounted on the snowboard between the bindings.

Referring to FIG. 1, a pole 10 according to the present invention is shown in perspective view. As shown in FIG. 1, the shaft 12 of the pole is in its collapsed or retracted position. At one end of the shaft is a transverse plate or basket 14 which performs the function of a ski pole basket and at the opposite end of the shaft is a hand grip 16 and a wrist strap 19. Positioned adjacent and between the grip 16 and the tip end 17 of the pole is a rear mount 18 which is adapted to receive a detent mechanism 26 which is built into the pole shaft adjacent end 17. A clip 22 is mounted on a snowboard adjacent the opposite end of shaft 12 and is adapted to receive and grip the shaft of the pole 12 when it is secured to the snowboard. In one embodiment, the clip is a metal, rubber or hard plastic base 23 supporting a flexible rubber split cylinder 25 with a gap 27 in the wall of the cylinder to allow the shaft of the pole to be press fitted into the opening between the opposite sides of the cylinder.

The rear mount 18 comprises a metal, plastic or rubber bracket 24 with a pair of apertures 29. Detent mechanism includes a pair of spring loaded pins 26 to permit the grip end of the pole to be attached to the board by engaging apertures 29 and permit a second function of allowing the grip end of the shaft to be pivoted and the plate or basket end of the shaft to be raised upwardly using bracket 24 as a pivot.

The pole 10 is shown in its fully extended position in FIG. 2. In FIG. 2 which is a perspective view of the pole, the pole is positioned above the rear mounting bracket 24 after release from the front clip 22. As shown in FIG. 2, the shaft 12 comprises four tubes 28,30,32, and 54. A series of apertures 38 are located at spaced intervals along tube 30, tube 32 and tube 54. A pair of detent pins 34 are located on opposite sides of tube 28 to engage the apertures 38 on tube 30 and lock tube 28 in position within tube 30. Similarly, detent pins 36 are provided in tube 30 to permit tube 30 to be locked into apertures 38 on tube 32. Detent pins 56 on tube 32 engage apertures 38 in tube 54. The grip 16 of the pole is secured to tube 54. Another pair of apertures 60 are provided in tube 30 to permit plate 14 to be rotated 90° and locked in position by detent mechanism 34.

The basket or plate 14 is secured to the opposite end of the shaft 12 at the end of tube 28. As shown in this embodiment, lugs 40 are molded into the bottom of basket 14 to provide the snowboarder with a better grip on the snow and ice when the pole is used to propel him along the surface of the snow. A series of apertures 42 are also provided in the basket to allow loose snow to pass through the basket and to allow the basket to reach a firmer base. This enhances the grip of the basket on the snow to provide a stronger push as it is being used by the snowboarder to traverse the snow or to aid the snowboarder in getting upright after a fall.

Figure 3:
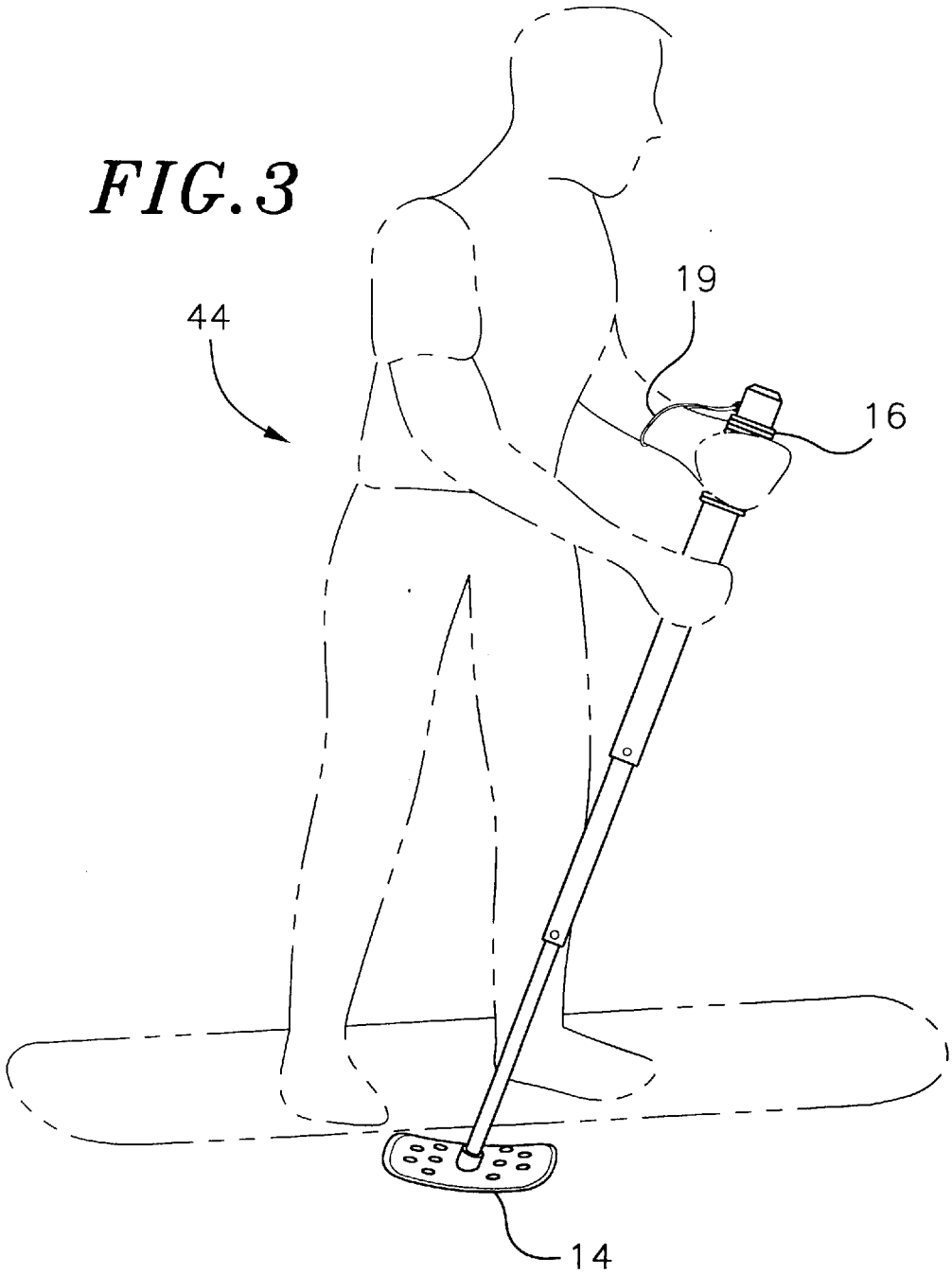
FIG. 3 is a diagrammatic view of a snowboarder using the pole of the present invention.

As illustrated in FIG. 3, a snowboarder 44 slides his/her hand through strap 19, grasps the grip 16 at the grip end of the pole, directs the basket end 14 behind him and angles the pole downward against the snow. By pushing on the grip end of the pole, the boarder propels himself along the surface of the snow to traverse level areas. FIG. 3 also illustrates the angular orientation of the snowboarder's feet across the board.

Figure 4A:
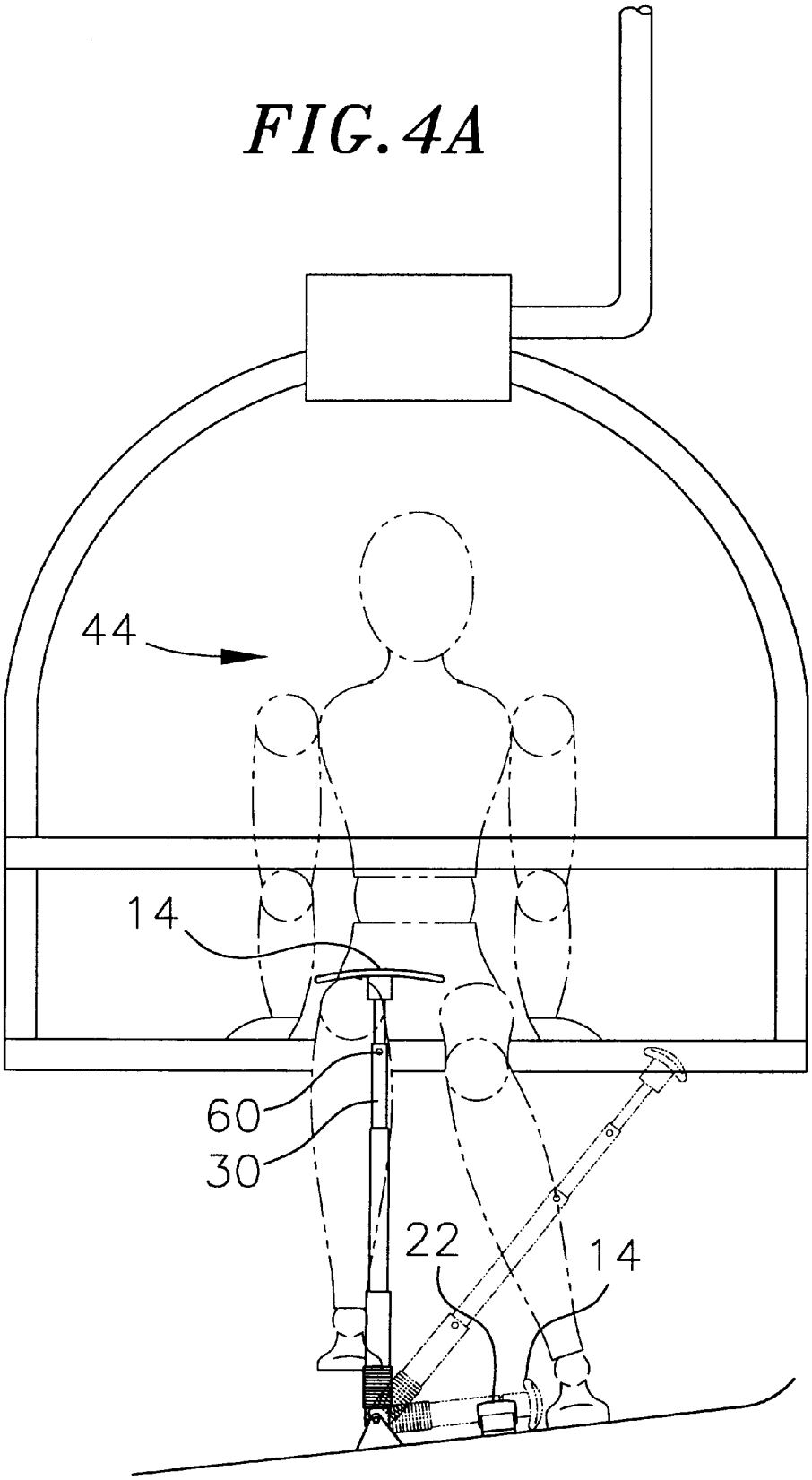
FIG. 4A is a front diagrammatic view of a snowboarder seated on a chairlift showing the pole of the present invention supporting the rear end of the snowboard on the snowboarder's knee.
Figure 4B:
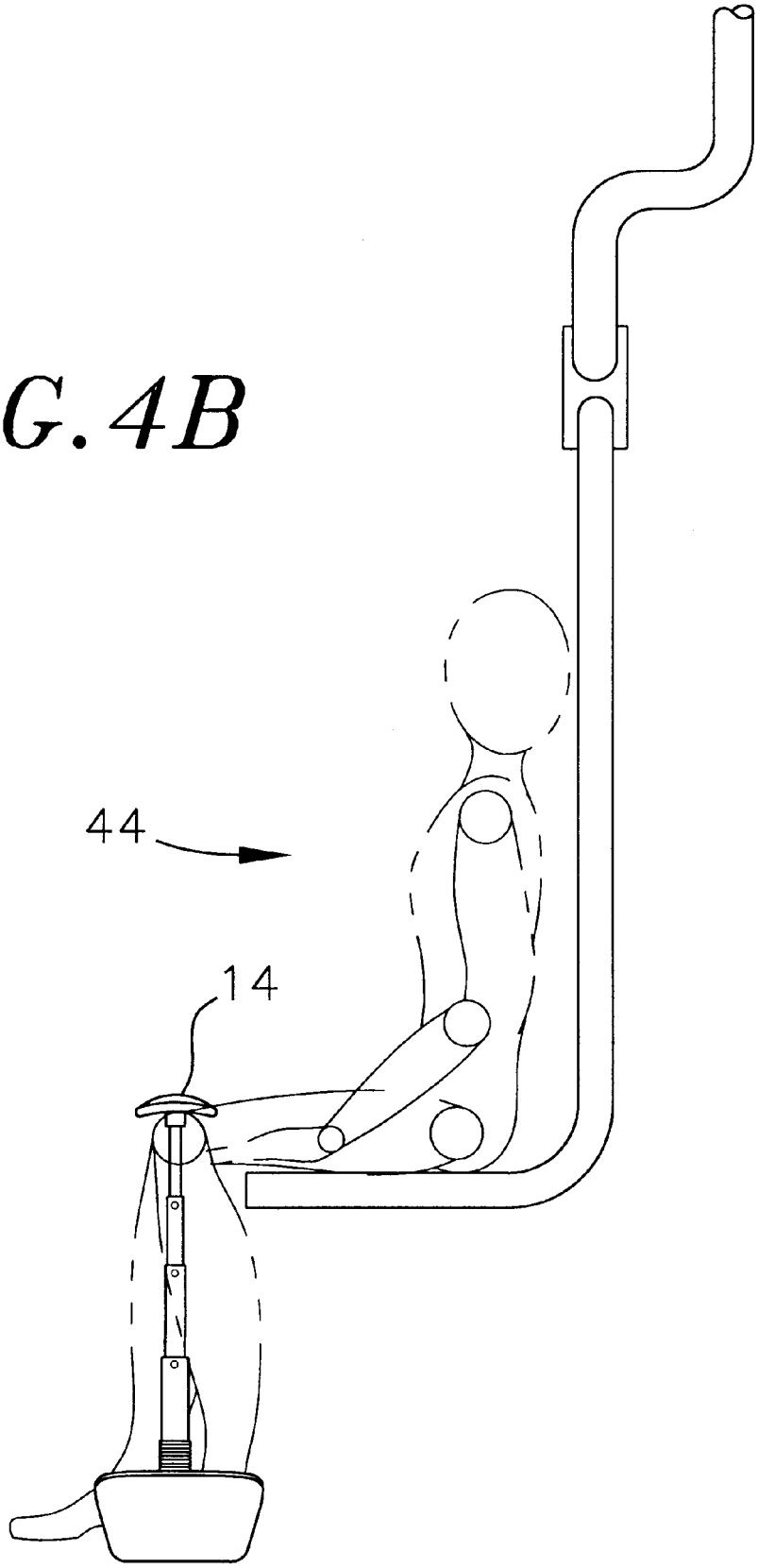
FIG. 4B is a side diagrammatic view of the snowboarder and chairlift in FIG. 4A.

The pole of the present invention has a distinct and separate function when the snowboarder 44 is riding up the slopes on a chairlift. As shown in the FIGS. 4A and 4B, the basket end of the pole is released from clip 22, and pivoted upwardly so that the inner side of the basket is raised to the level of the knee of the snowboarder. Simultaneously, the snowboarder manually adjusts the pole with the detent mechanisms 34, 36, 56 on the pole shaft to match the approximate height of the knee of the rear or unbuckled leg. A second pair of apertures 60 are provided in shaft 30 to permit the basket to be rotated 90° and locked by detent 34 so that the basket can be used to raise and level the snowboard during the ride on a chairlift. One side of the basket 14 is then placed over the rear knee of the snowboarder to support the rear end of the snowboard causing the board to be brought to and maintained in a near horizontal position during the ride. This relieves and removes the twist and tension on the snowboarder's ankle that would otherwise result from the snowboard dangling from one foot.

Figure 5:
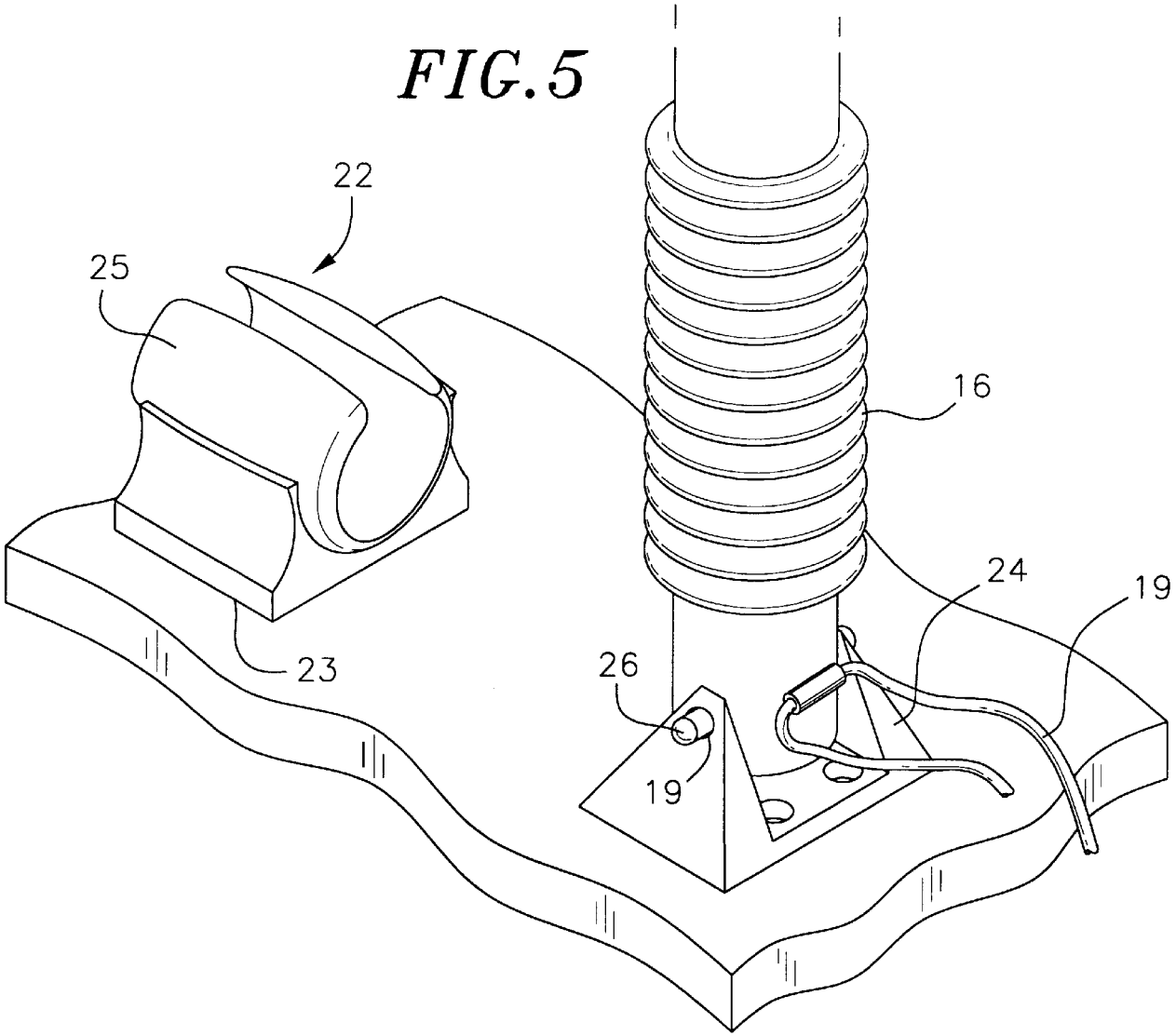
FIG. 5 is a close up perspective view of the rear mounting bracket and the front clip for securing the pole to the snowboard.
Figure 6:
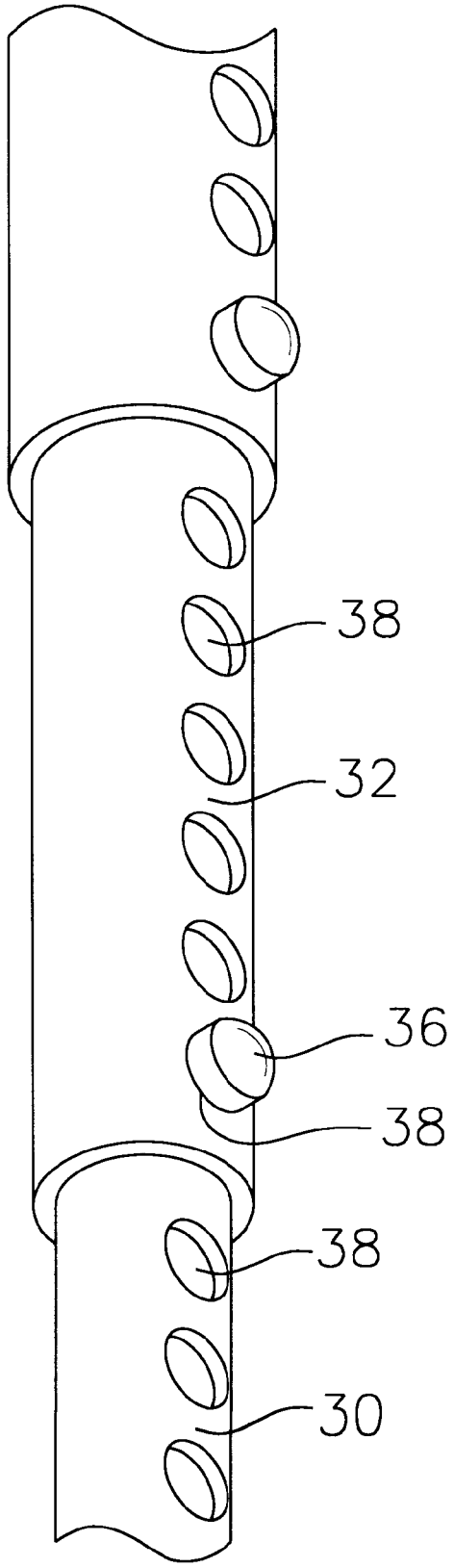
FIG. 6 is a detailed elevation view of the telescoped sections of the pole and a detent mechanism for holding adjacent sections of the pole in the desired extended or retracted position.

Further details of the pole according to the present invention are shown on FIGS. 5 and 6. In FIG. 5, the grip 16 is shown in detail as it is mounted on the shaft and positioned adjacent to bracket 24 when the pole is mounted on the snowboard. Pins 26 are engaged with apertures 29 in bracket 24. The grip 16 can be chosen from a number of different materials but is provided with a molded or textured surface to enhance the gripability and permit the snowboarder to comfortably grasp the grip end of the pole while wearing gloves. The clip 22 that secures the basket end of the shaft to the snowboard is also shown in FIG. 5. As illustrated therein, it is a plastic, metal or rubber housing 23 with a section of the cylinder removed so that the shaft can be slipped into the space formed by the cylinder and held in position until it is pulled from its nested location by the snowboarder.

Likewise the details of the apertures 38 and the detent mechanism of three of the shafts of the pole are shown in FIG. 6. As illustrated therein, a detent pin 36 is shown engaged in the apertures 38 on shaft 32 to lock shaft 30 into position in shaft 32.

What is claimed is:

1. A pole for use in traversing snow surfaces on a snowboard comprising:

a manually extendable and retractable shaft comprising at least two hollow tubes telescoped within each other and detents for securing the shafts together in retracted and extended positions;

a plate having an elongated shallow curved shape mounted transversely at one end of the shaft; and a spring loaded detent mechanism adjacent the end of the shaft opposite the plate, for securing said end of the pole to a snowboard, said detent mechanism having a pair of detent buttons extending from opposite sides of the shaft.

2. A pole according to claim 1 wherein the longitudinal axis of the plate is parallel to the axis of the detent buttons.

3. A pole according to claim 2 including a grip on the pole adjacent the attachment mechanism and opposite the plate end of the pole.

4. A snowboard and pole combination comprising:

an elongated snowboard having a spaced apart front and rear binding located along the longitudinal axis of the snowboard;

an extendable and retractable pole adapted to be attached to the snowboard secured thereto between the bindings;

a plate of a predetermined configuration attached at one end of the pole;

a detent mechanism located at the opposite end of the pole;

a bracket mounted on the snowboard adjacent the rear binding for receiving the pole and the detent mechanism;

a clip mounted on the snowboard adjacent the front binding for receiving the pole;

wherein when the pole is removed from the snowboard and extended to its elongated and locked position, the pole can be used to enable the user to traverse a level area.

5. A snowboard and pole combination according to claim 4 wherein the bindings are angularly positioned across the longitudinal axis of the board.

6. A snowboard and pole combination comprising:

an elongated snowboard having a spaced apart front and rear binding located along the longitudinal axis of the snowboard;

an extendable and retractable pole adopted to be attached to the snowboard and basket secured thereto between the bindings;

a plate of a predetermined configuration attached at one end of the pole;

a detent mechanism located at the opposite end of the pole;

a bracket mounted on the snowboard adjacent the rear binding for receiving the pole and the detent mechanism therebetween;

a clip mounted on the snowboard adjacent the front binding for receiving the shaft of the pole;

wherein when the front end of the pole is disengaged from the snowboard and raised vertically approximately 90°, the basket can be used to engage the knee of the unbuckled foot to balance the snowboard.

7. A snowboard and pole combination according to claim 6 wherein the bindings are angularly positioned across the longitudinal axis of the board.

8. A snowboard and pole combination according to claim 6 including a second detent mechanism mounted in the pole to enable rotation of the plate about the longitudinal axis of the pole.

* * * * *